US006624397B2

(12) United States Patent
Tateishi

(10) Patent No.: US 6,624,397 B2
(45) Date of Patent: Sep. 23, 2003

(54) ELECTRIC CIRCUIT FOR PORTABLE HEATER

(76) Inventor: Art K. Tateishi, 25 Warrender Avenue, Apt. #202, Islington, Ontario, M9B 5Z4 (CA)

( * ) Notice: Subject to any disclaimer, the term of this patent is extended or adjusted under 35 U.S.C. 154(b) by 0 days.

(21) Appl. No.: 09/965,845

(22) Filed: Oct. 1, 2001

(65) Prior Publication Data

US 2003/0062362 A1 Apr. 3, 2003

(51) Int. Cl.[7] ..... H05B 1/02

(52) U.S. Cl. ..... 219/508; 392/360; 392/365; 219/480; 219/483; 219/481

(58) Field of Search ..... 219/483–486, 219/481, 497, 508; 392/360–370

(56) References Cited

U.S. PATENT DOCUMENTS 4,302,663 A * 11/1981 Chesnut et al. ..... 219/364
4,327,278 A * 4/1982 Tomaro ..... 219/364
4,923,681 A * 5/1990 Cox et al. ..... 422/116
5,825,974 A * 10/1998 Hutton et al. ..... 392/360
6,397,002 B1 * 5/2002 Bucher et al. ..... 392/368

* cited by examiner

*Primary Examiner*—Mark Paschall

(57) ABSTRACT

A heater effectively uses a current controlled fan motor in series with a resistance heating arrangement. The fan motor preferably is wound with a gauge of wire to appropriate for the relatively high current provided to the fan motor. This arrangement is effectively used to adjust the fan speed to match the heat output when the heating arrangement has variable heat output. More desirable operating characteristics are achieved without increasing costs and fan motor manufacturing savings are realized. The portable heater preferably produces heat at different outputs and the current used to power the resistance heating arrangement is used to power the fan motor.

23 Claims, 4 Drawing Sheets

SWITCH CONTACT SCHEMATIC

| | L | 1 | 2 | 3 |
|---|---|---|---|---|
| OFF | O | O | O | O |
| PILOT LIGHT | * | O | * | O |
| 500 W | * | * | * | O |
| 1000 W | * | O | * | * |
| 1500 W | * | * | * | * |

* = CLOSED

O = OPEN

ELECTRIC CIRCUIT FOR PORTABLE HEATER

FIELD OF THE INVENTION

The present invention relates to electrical circuits for heaters and in particular, relates to the heating circuit of a heater where a fan motor is controlled by the current used to power the heating element.

BACKGROUND OF THE INVENTION

Portable heaters are commonly used to provide supplemental heat for a localized area or space to improve the comfort level. There are many heaters having a metal housing such as baseboard, ceramic, parabolic and oil filled heaters. More recently, flame retardant polymers have been used for plastic housings and a fan provides efficient heat transfer. The use of a fan driven motor to provide a forced airflow across the heating elements allows the size of the portable heater to be reduced relative to portable heaters that operate on a natural convection cycle. When the elements are activated the fan motor typically operates at the same speed and does not appreciably vary with heat output. The fan motors are voltage controlled and designed to operate with low current. Typically, the motors are placed in parallel with the heating elements.

Examples of fan driven heaters with at least two different power outputs are disclosed in U.S. Pat. No. 4,755,653, U.S. Pat. 5,434,386, U.S. Pat. No. 5,663,633 and U.S. Pat. No. 5,245,691.

Some fan driven portable heaters also include a fan mode where no heat is produced and the device merely operates as a fan. The fan mode typically includes a switch for varying the fan speed. Most portable heaters include two or three heating elements which can be combined to produce three different heat outputs. In most cases, the heating elements are provided in a parallel configuration, however, it is possible to have one of the elements in parallel with two other elements connected in series.

A common heating circuit has the fan motor in parallel with the heating elements and operating with less than 0.5 amps. A switch is provided on the portable heater which allows the user to set the desired heat output level. In the heat generation mode, the fan motor is in parallel with the heating elements, and operates at a constant speed. Portable heaters of this type may include a separate fan speed control which is only operative when the heating elements are not functioning.

Portable heaters are designed to be connected to a 120 volts wall receptacle typically having a 15 amp current capacity. To produce 1500 watts of power this implies the current will be approximately 12.5 amps and produces approximately 5120 BTU's of heat. This amount of heat generation requires a substantial airflow to maintain a low operating temperature with the plastic molded heater housing. A high fan speed is required at the maximum heat output and produces a significant amount of noise. As the fan runs at high speed for all heat output conditions, unnecessary noise is produced at lower heat outputs. Multispeed motors and/or resistors can be used to drop the voltage to the fan motor but significantly add to the cost of the heater and complicate the manufacturing process. These high speed, low current fans include many windings of small gauge wire which is prone to breakage and is more expensive relative to heavier gauge magnetic motor wire. As such, these motors represent a major cost component of the heater.

Various improvements have been proposed with respect to portable heaters to include additional features such as night lights or combining these heaters with other appliances such as humidifiers.

The purchase of a portable heater remains a price sensitive purchase as the heater is typically solving a specific problem requiring a temporary solution. Therefore, effective design of the portable heater is required to produce an acceptable product.

SUMMARY OF THE INVENTION

A portable heater according to the present invention comprises an electric circuit which powers a resistance heating arrangement and an electric fan and wherein the electric fan receives and is powered by a current which powers the resistance heating arrangement.

In a preferred aspect of the invention the electric fan is designed to operate at high current.

In a further aspect of the invention the electric fan is wound with 20 gauge or heavier wire.

In a further aspect of the invention the electric fan is wound with wire rated to carry at least 8 amperes and each pole of the motor has less than 50 turns.

The heating circuit of a preferred aspect of the present invention comprises a first heating element and a second heating element with a fan motor connected in series with each of these elements. A multi-position switch selectively connects a power input means with the heating elements and the fan induction motor. In a first position of the switch, the power input means is connected with the first heating element and the fan induction motor in series therewith, resulting in the fan operating at a first speed with the first heating element producing a first heat output. In a second position of the multi-position switch, the power input means is connected to the second heating element with the fan motor in series therewith and causes the fan motor to operate at a second speed greater than the first speed and the heating element produces heat at a second heat output greater than the first heat output.

With this arrangement, the fan motor speed automatically increases with increasing power of the heating elements.

Several advantages are achieved with the heating circuit of the present invention. The fan motor is easily manufactured and cooperates with the heating elements to provide effective control and safe operation. In a preferred embodiment automatic adjustment of the fan motor speed as the heat output increases or decreases effectively matches the fan motor speed with the heat output. By reducing the fan speed as the power of the heater decreases, the discharge temperature of the air as it leaves the heater is higher. Also the lower operating speed of the motor reduces motor noise and is less intrusive. The automatic adjustment of the fan motor speed is achieved by using the heating elements to vary the current to the fan motor. Thus, no additional elements have been added to the heating circuit to achieve the automatic speed adjustment of the fan.

In a preferred aspect of the invention, the multi-position switch includes a third position where the heating elements are connected in parallel with these parallel heating elements being connected in series with the fan induction motor. This results in the heating elements collectively generating heat at a third power and cause the fan to operate at a third speed.

In yet a further aspect of the invention, the fan motor is appropriately wound to pass the operating current therethrough without damage should the rotor become locked.

In yet a further aspect of the invention, the fan motor is wound with a wire of at least 20 gauge.

In yet a further aspect of the invention, the fan motor is powered with a current of at least two amps.

In yet a further aspect of the invention, the operating speed of the fan is controlled by the current provided thereto which correspondingly varies in proportion to the power output of the heating circuit.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
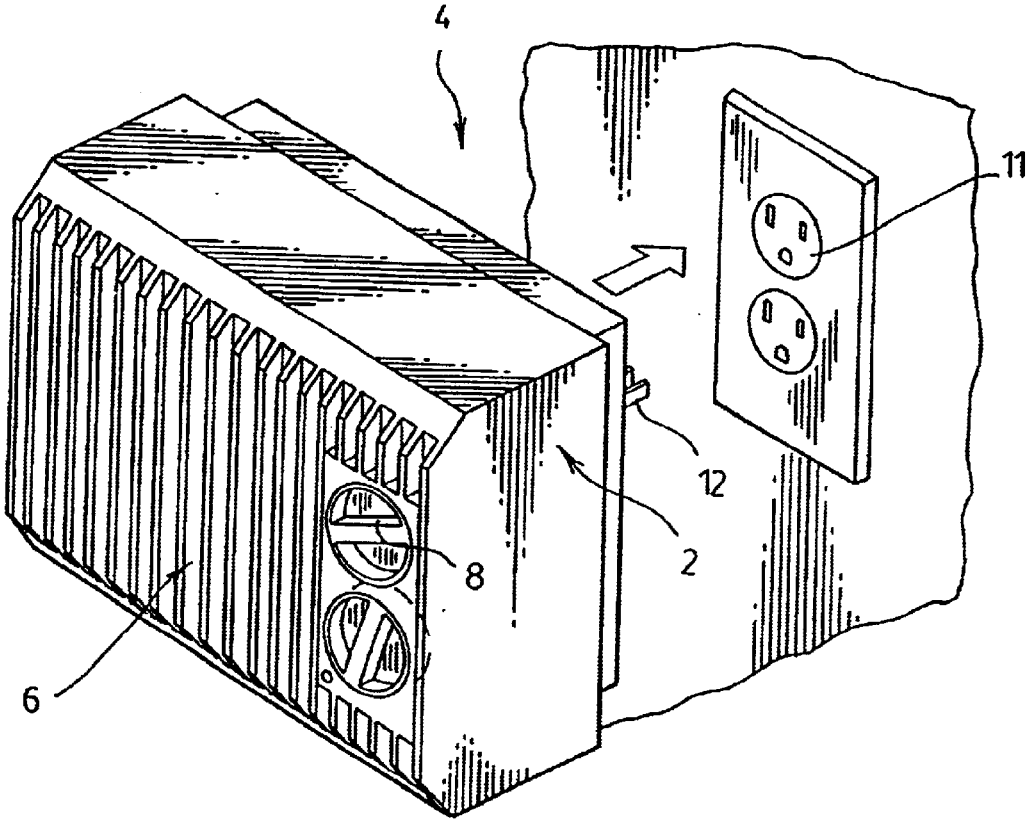
FIG. 1 is a perspective view of a portable heater.

The portable heater 2 of FIG. 1 includes an air inlet 4, an air outlet 6, a multi-position switch 8 and an electrical plug 12 for connecting the portable heater to the electrical supply 11. Interior to the housing 12 is an electrical circuit for producing heat and controlling of the fan.

Figures 2, 2A:
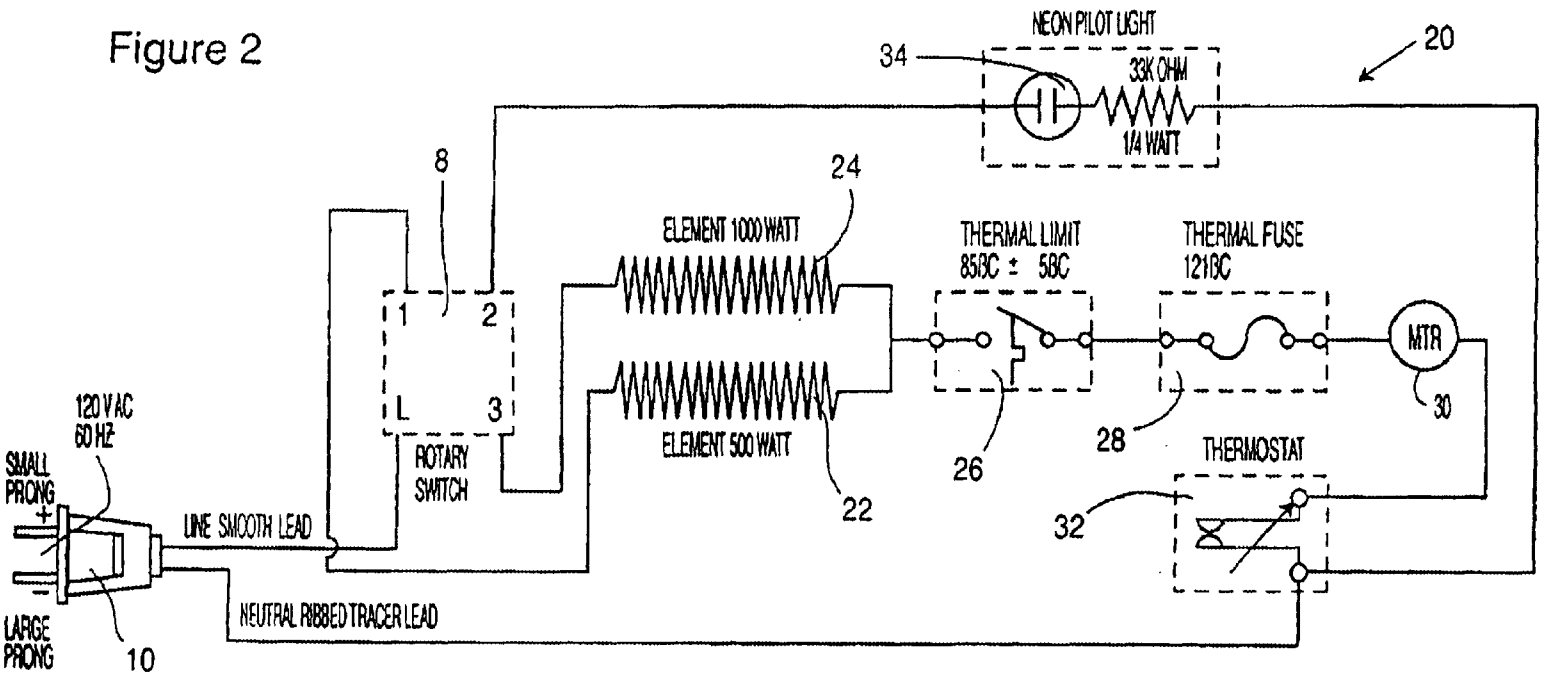
FIG. 2A is a table showing the active branches of the circuit.
FIG. 2 is schematic of the heating circuit.

The preferred heating circuit 20 of FIG. 2 includes the electrical plug 10, a rotary switch 8, a first heating element 22, a second heating element 24, an automatic resetting thermal limit switch 26, a thermal fuse 28, and a fan motor 30 in series with the heating elements 22 and 24. A variable thermostat 32 controls the cutout for a desired temperature selected by the user. The circuit also includes the pilot light 34.

The multi-position switch 8 of FIG. 2 selectively connects the heating elements 22 and 24 to the electrical plug 10 as indicated in the table 2A. In a first position of the rotary switch, the 500 watt heating element 22 is connected in series with the fan motor 30. With this arrangement, the current to the motor 30 is relatively low (approximately 4 amps) and as such, the fan motor will operate at a low speed (1100 rpm).

In a second position of the multi-position switch 8, the 1000 watt element 24 is connected in series with the fan motor 30. In this second position, element 22 is not powered. The current to the motor 30 is at a higher level (approximately 8 amps) causing the speed of the motor 30 to increase (motor speed approximately 1800 rpm). The higher speed of the motor increases the airflow through the portable heater and over the heating elements. In this way, the airflow is increased as the heat output of the electrical circuit is increased.

In a third position of the multi-position switch, heating elements 22 and 24 are each powered as parallel elements. This is the maximum output position for the portable heater and produces 1500 watts. The motor 30 again is in series with the heating elements 22 and 24 and as such, the current to the motor is higher (approximately 12 amps). The higher current causes the speed of the motor to increase (approximately 2800 rpm) and thereby increase the airflow through the heater.

With this circuit, the fan motor 30 automatically increases in speed as the heat output from the heating elements 22 and 24 is increased. Thus the heating elements appropriately vary the current provided to the series wound motor 30 and automatically produces a speed increase as the heat output of the circuit is increased.

With this arrangement, the fan motor 30 is subject to substantially higher currents relative to the traditional approach of placing the fan motor 30 in parallel with the heating elements. One of the preferred embodiments of the invention modifies the fan motor 30 by using an induction motor wound with a relatively heavy gauge magnetic wire. This basically protects the motor in the event that the rotor is locked. Although there is a temperature rise in both the stator and the rotor, the temperatures are well within acceptable ranges and the motor does not require separate protection. To provide protection for the anticipated 12.5 amps of current, 18 gauge wire or greater can be used.

The automatic speed control of the fan motor 30 is achieved by using the heating elements to regulate the current to the motor. The fan motor speed automatically changes as a function of the heat output of the circuit. With this arrangement, the discharge air from the portable heater is more consistent regardless of the power output of the heating elements. This is in contrast to the prior art arrangements where the fan motor during the heat output mode runs at constant speed determined by the maximum power output of the circuit. As can be appreciated, at a high heat output, a substantial airflow is required to keep the operating temperature in the housing below a particular level. As the power output decreases, this high airflow lowers the discharge temperature of the airflow and unnecessarily further decreases the temperature within the housing.

In contrast with the automatic speed adjustment provided by the heating circuit of FIG. 2, the discharge air temperature from the heater is more consistent as the speed of the motor has been varied in proportion to the heat output of the circuit and the temperature within the housing is maintained below a particular level.

In the preferred embodiment of FIG. 2, the 1500 watt heat output is achieved with a current of approximately 12.5 amps and a motor speed of approximately 2800 rpm. At 1000 watts, the current is approximately 8 amps and the motor speed is approximately 1800 rpm. At 500 watts, the current is approximately 4 amps and the motor speed is approximately 1100 rpm. The voltage drop across the fan induction motor is from one to five volts. The fan induction motor is a high current low voltage motor wound with relatively heavy gauge wire.

As can be seen from the above circuit, the current used to power the heating elements is used to provide current control of the operating characteristics of the fan induction motor. Current controlled motors have a desirable, relatively linear or flat torque curve where the output rpm closely corresponds to the drive current. In particular, the output speed of the motor is in approximate proportion to the current.

In yet a further aspect of the invention, the fan induction motor 30 is wound with 18 gauge wire or heavier gauge wire to provide automatic protection in the event that the rotor becomes locked. Basically the heavy gauge wire of the stator is sized to carry the current and the heavy gauge wire in the rotor increases in temperature but is not damaged. Thus the motor itself is self-protecting and the heating circuit and housing is protected by the automatic resetting thermal limit switch 26 and the thermal fuse 28. In the event that the rotor becomes locked, there will be no airflow through the heater and thus the temperature within the housing will increase and the thermal protection will serve its normal purpose. In this way, the automatic thermal limiting switch 26 and the thermal fuse 28 are sufficient to protect the circuit and the fan motor.

The various speeds of the motor can be fine tuned by combination of the number of turns, the lamination stack size, the rotor resistance, as well as the pitch of the blade used by the fan. Preferably the motor can be wound with 14 gauge wire which is the same wire traditionally used with respect to providing power input to the heater. This simplifies the approval process with respect to the Underwriter's Laboratory and the Canadian Standards Association. 18 gauge wiring is rated to carry in excess of 12.5 amps of current.

Figure 3:
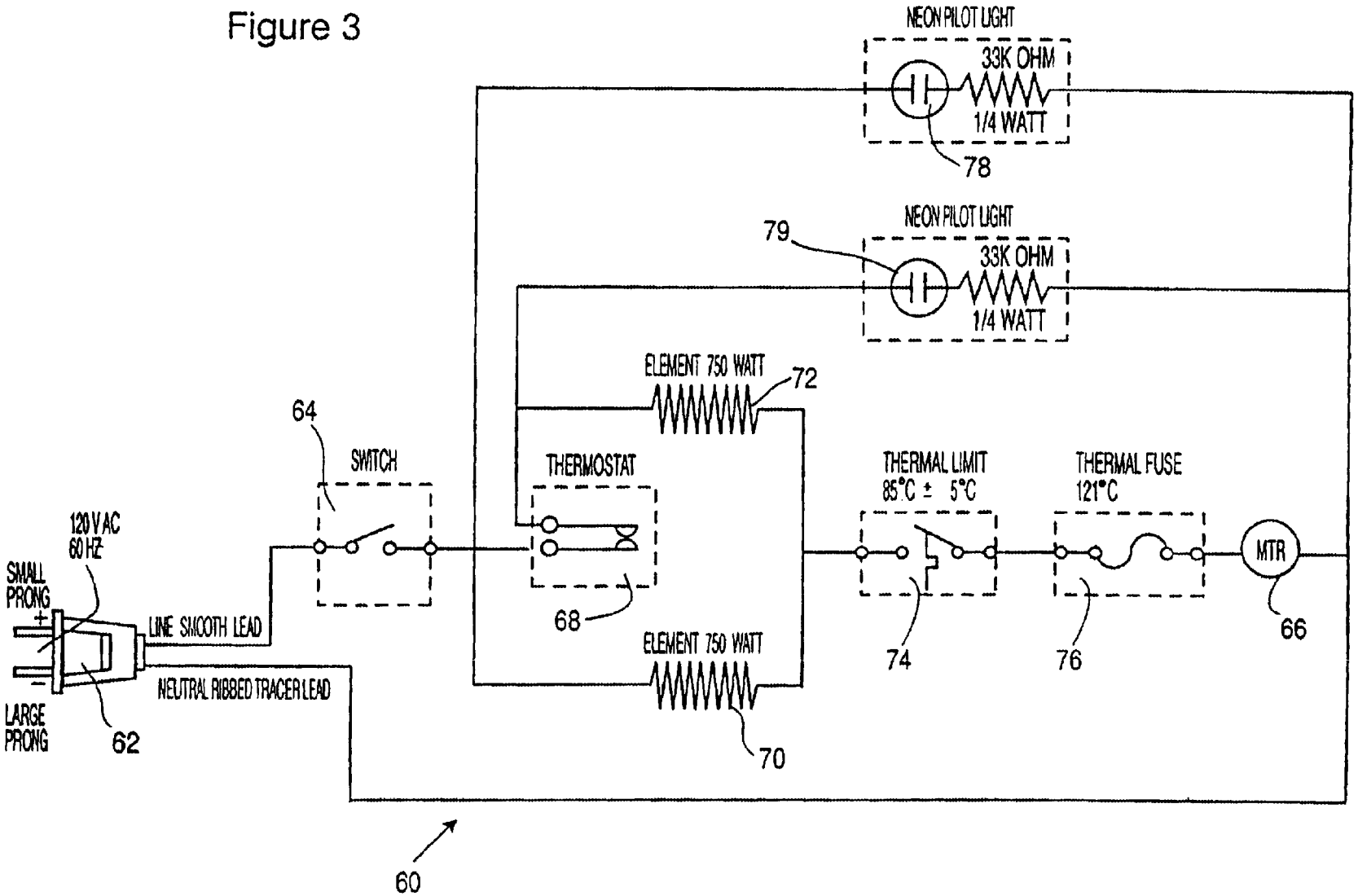
FIG. 3 is a schematic of a modified heating circuit.

A modified heating circuit 60 is shown in FIG. 3. This circuit again has the fan motor 66 in series with either the first heating element 70 or the second heating element 72 which in this case, form the heating arrangement. Each heating element when powered, produces 750 watts. The heating circuit 60 includes an electrical plug 62 for connecting to a power source and the heating circuit is powered by means of the on/off switch 64. The heating circuit when on, produces either 1500 watts of heat or 750 watts of heat. The thermostat 68 selectively provides power to element 72 and the neon pilot lights 78 79. Initially the heating circuit operates at a high output such that heating elements 70 and 72 are on. The thermostat 68 powers element 72 as the temperature is below the user set temperature. The fan motor 66 is in series with the heating elements 70 and 72 and receives a relatively high current producing a high fan speed and high airflow.

The thermostat 68 at the user set temperature disconnects heating element 70 leaving only heating element 72 powered. The current now provided to the fan motor 66 is reduced, thereby reducing both the speed of the fan motor and the rate of airflow. The heat output has now been adjusted to 750 watts. With this arrangement, the fan motor automatically adjusts in speed as the heat output of the circuit is either increased or decreased. The heating circuit operates at a first power level, i.e., 1500 watts, until a certain temperature is achieved at which time the circuit shifts to a lower power setting of 750 watts. If the temperature continues to drop, the thermostat 68 disconnects the second heating element and activates the first heating element. Again, with this circuit, a thermal limit switch 74 is provided as well as a thermal fuse 76 and the pilot light 78. A multi-position switch can be used with this circuit to modify the mode of operation of the heater. One mode can be the continuous heat mode described above. A second mode can render only element 72 active. In this mode ON/OFF heat a lower rate is achieved. In a third mode, element 70 and 72 are connected in parallel after the thermostat to produce maximum ON/OFF heat output. In all cases the fan motor automatically adjusts in speed to the heat output.

The heating circuits of the present invention provide a simple arrangement for effectively using the heating elements to regulate the speed of the fan motor such that it operates at a lower rate of speed when the heat output is relatively low and operates at a higher rate of speed when the heat output is increased. Preferably, the motor is a fan induction motor which is wound with heavy gauge wire to withstand, without further protection, the operating current if in fact the rotor becomes locked. In this way the existing thermal limit switch and the thermal fuse will be sufficient to protect the portable heater. Certain desirable features are achieved in that the reduction in fan speed reduces the amount of noise produced and allows the discharge temperature of the airflow from the heater to be more consistent. To the user the airflow discharge temperature is more comforting.

FIG. 3 provides a simple solution for providing more consistent room temperature. When the lower power output is not sufficient to maintain the desired temperature, the additional 750 watt element is powered due to a change in temperature sensed by the thermostat. This mode of operation eliminates the abrupt off/on characteristics of many portable heaters and reduces noise at the lower power output.

Figure 4:
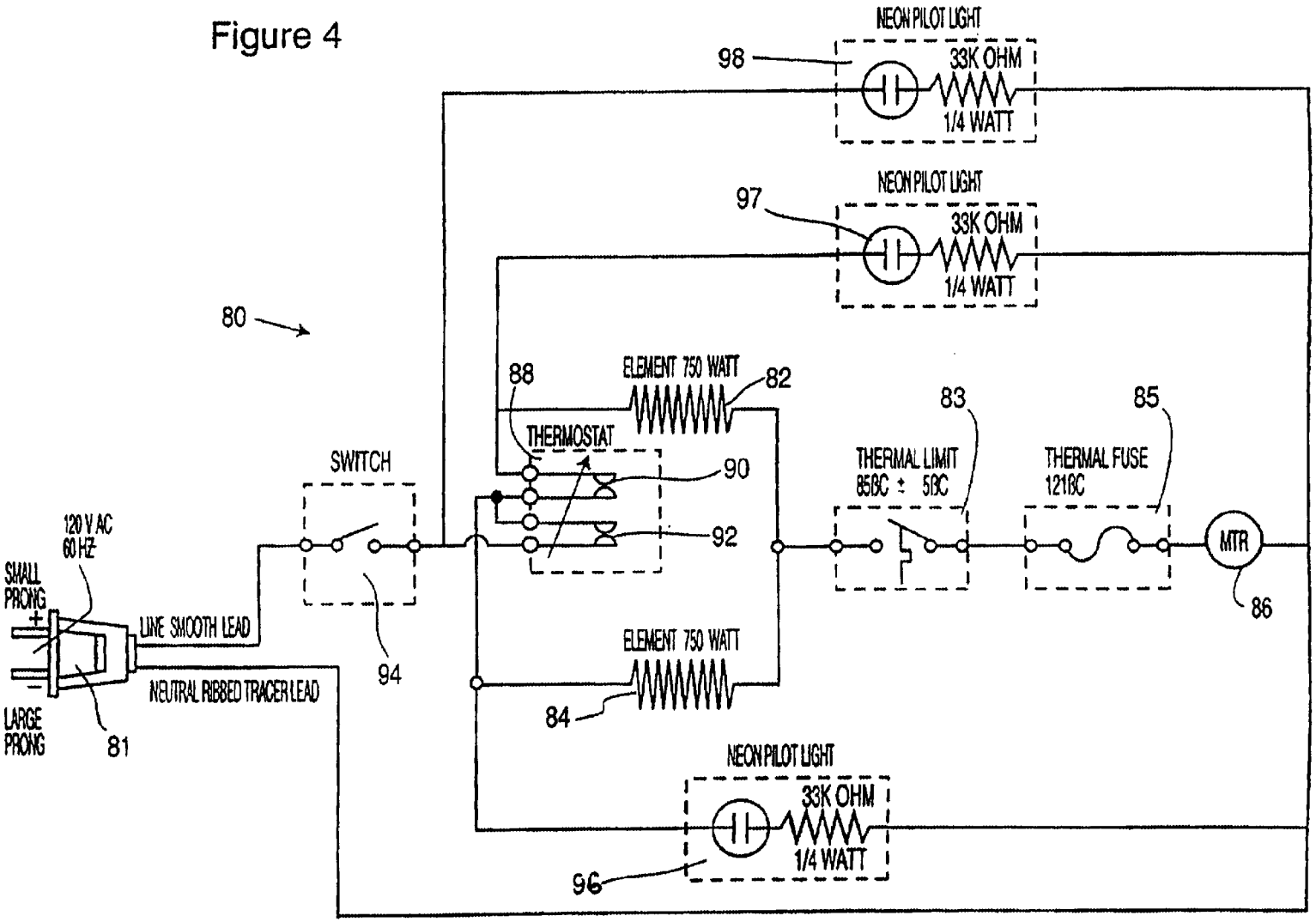
FIG. 4 is a schematic of a further heating circuit.

FIG. 4 shows a further circuit 80 that utilizes the operating heating elements to control the speed of the fan motor 86. A settable two stage thermostat 88 has a first cut out temperature controlled by contacts 90 which switch element 82 on or off. A second cut out temperature is controlled by contacts 92 and switch element 84 on or off. Switch 94 turns the heater on or off. Pilot light 96 switches on and off with element 84, pilot light 96 switches on and off with element 82, and pilot light 98 switches on and off with switch 94. Electrical plug 81 provides power to the circuit, and thermal limit switch 83 and thermal fuse 85 provide thermal protection.

Fan motor 86 runs at high speed with both elements 82 and 84 on, and at a reduced speed when only element 84 is on. The fan motor is of the design described in the circuit of FIG. 2 and FIG. 3.

Preferably the fan motor is a shaded two pole induction motor wound with 18 gauge wire with approximately 14 turns per pole. The fan motor operates at approximately 2800 rpms when the heating circuit produces 1500 watts of heat, 1800 rpms when the heating circuit produces 1000 watts and approximately 1100 rpms when the heating circuit produces 500 watts of heat. The voltage drop across the motor is approximately 4.8 volts at 1500 watts, 3.8 volts at 1000 watts and 2.1 volts at 500 watts. The motor parameters are easily adjusted as previously indicated.

The use of heavy gauge wire and the requirement for only a low number of turns per pole is space efficient and the motor if desired can include a second winding. This second winding would be connected in series with one heating element and have a selected gauge and number of turns to produce a desired fan speed. The first winding would be sized and have the desired number of turns to cooperate with a first heating element to produce a desired fan speed. The second winding allows more flexibility in achieving different fan speeds as a function of the operating heating elements. The size of the motor remains small and the motor remains cost effective to manufacture in applications requiring fine speed control.

It can readily be appreciated that different heat outputs can be used and the fan speed will appropriately adjust to the particular output.

The use of heavy gauge wire is more cost effective as the manufacturing is simplified (less windings) and problems associated with wire breakage during manufacture is reduced. Heavy gauge wire is more price competitive and the amount of material (copper) is reduced. Therefore, the heavy gauge wire provides material and manufacturing advantages.

The circuit has been described as applied to portable heaters where automatic fan speed is accomplished in a simple manner. This approach is also suitable for other heating applications where a variable speed airflow is used in combination with a heating arrangement for producing different heat outputs. Specific voltages and currents have been disclosed which are typical for North America but other voltages and currents will vary with the particular power system. For example, 220 volt power supply is more common in European countries.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An electric circuit of a heater said electric circuit comprising at least a first heating element and a second heating element, a fan motor connected in series with each of said heating elements, a multi-position switch which selectively connects a power input means with said heating elements and said fan induction motor, said multi-position switch in a first position providing a first circuit connecting said power input means and said first heating element and said fan induction motor in series and causing said fan motor to operate at a first speed and causing said first heating element to produce heat at a first power, said multi-position switch in a second position disconnecting said first circuit and providing a second circuit connecting said power input means and said second heating element and said fan motor in series and causing said fan motor to operate at a second speed greater than said first speed and causing said second heating element to produce heat at a second power greater than said first rate of power, whereby the fan motor speed is automatically increased with increased power of said heating elements.

2. A heating circuit as claimed in claim 1 wherein said multi-position switch includes a third position connecting said heating elements in parallel with said power input means and connecting said fan induction motor in series with said heating elements to power said first circuit and said second circuit causing said heating elements to collectively generate heat at a third power greater than said second power and causing said fan induction motor to operate at a third speed greater than said second speed.

3. A heating circuit as claimed in claim 2 wherein said fan motor is wound with a wire of at least 20 gauge.

4. A heating circuit as claimed in claim 1 wherein said fan motor when powered has a current of at least two amps.

5. A heating circuit as claimed in claim 1 wherein the operating speed of said fan motor is controlled by current which varies in accordance with the power output of said heating circuit.

6. A heater circuit for an electric heater comprising at least a first heating element generating heat at a first power and a second heating element generating heat at a second power greater than said first power, a fan induction motor connected in series with each of said heating elements, a multi-position switch which selectively connects a power input means with said heating elements and said fan induction motor, said multi-position switch in a first position connecting said power input means and said first heating element and said fan induction motor in series in a first circuit and causing said fan motor to operate at a first speed, said multi-position switch in a second position disconnecting said first circuit and connecting said power input means and said second heating element and said fan induction motor in series in a second circuit and causing said fan motor to operate at a second speed greater than said first speed, whereby the fan motor speed is automatically increased with increased power of said heating elements.

7. A heater circuit as claimed in claim 6 wherein said multi-position switch includes a third position connecting said heating elements in parallel with said power input means and said fan induction motor in series with heating elements powering both said first circuit and said second circuit causing said heating elements to collectively generate heat at a third power greater than said second power and causing said fan induction motor to operate at a third speed greater than said second speed.

8. A heater circuit as claimed in claim 7 wherein said induction motor is wound with a wire of at least 20 gauge.

9. A heater circuit as claimed in claim 6 wherein said fan induction motor when powered has a current of at least two amps.

10. A heater circuit as claimed in claim 8 wherein said fan induction motor at said third speed operates with a current in excess of 10 amps.

11. A heater circuit as claimed in claim 6 including in series with said fan induction motor a resettable temperature cut out switch and a temperature fuse.

12. A heater circuit as claimed in claim 6 wherein said first power is approximately 500 watts, said second power is approximately 1000 watts and said third power is approximately 1500 watts.

13. A heater circuit as claimed in claim 12 including in series with said fan induction motor a temperature cut out switch and a temperature fuse.

14. A heater circuit as claimed in claim 12 wherein said fan induction motor is wound with 14 gauge wire.

15. A heater circuit as claimed in claim 14 wherein said fan induction motor is driven by a current between 3 and 15 amps.

16. A heater circuit as claimed in claim 6 including a two position temperature responsive switch, said two position temperature responsive switch in a first position connecting in series said fan induction motor and said first element to said input means and in said second position connecting in series said fan induction and said second element, said two position temperature responsive switch measuring an air temperature relative to a fixed temperature and operating in said second position when said measured air temperature is above said fixed temperature and switching to said second position when said measured air temperature is below said fixed temperature.

17. A heater circuit as claimed in claim 16 including a further temperature sensor switch for interrupting power to said circuit upon sensing a further air temperature above said fixed temperature.

18. An electric circuit of a portable heater comprising a fan induction motor positioned in series with a plurality of heating elements, a multi-position switch for selectively connecting said heating elements in series with a power source and said fan induction motor to produce different heat outputs, said fan induction motor being regulated by said heating elements to automatically alter the fan induction motor speed in proportion to the heat output.

19. An electric circuit as claimed in claim 18 wherein said induction fan motor is powered by a current which varies in proportion to the selected heat output.

20. An electric circuit as claimed in claim 19 wherein said fan induction motor is powered by a current of at least 2 amps and less than 15 amps, and said fan induction motor is a 2 pole motor with a stator and rotor wound with at least 20 gauge wire.

21. A heater comprising an electric circuit which powers a resistance heating arrangement of selectable resistance heaters and an electric fan, and wherein the electric fan receives and is powered only by current which flows through and powers selected one or ones of said selectable resistance heaters of the resistance heating arrangement.

22. A heater as claimed in claim 21 wherein said resistance heating arrangement produces different heat outputs and said fan speed varies in proportion to the heat output.

23. A heater as claimed in claim 21 wherein said electric circuit includes a multi-position switch for selecting different heat outputs, and wherein said resistance heating arrangement includes at least two resistance hating elements, said multi-position switch selectively connecting said resistance heating elements in series with said electric fan to produce different heat outputs and to automatically vary an operating speed of the electric fan as a function of the selected heat output.

* * * * *